US007028853B1

(12) United States Patent
Simms

(10) Patent No.: US 7,028,853 B1
(45) Date of Patent: Apr. 18, 2006

(54) HAIR ACCESSORY ORGANIZER DEVICE

(76) Inventor: Sadie V. Simms, 3795 Carlotta St., Grove City, OH (US) 43123

( * ) Notice: Subject to any disclaimer, the term of this patent is extended or adjusted under 35 U.S.C. 154(b) by 219 days.

(21) Appl. No.: 10/763,871

(22) Filed: Jan. 26, 2004

(51) Int. Cl.
*A47F 7/19* (2006.01)

(52) U.S. Cl. ..... 211/85.3; 211/13.1; 211/126.2; D3/901

(58) Field of Classification Search .. 211/126.1–126.9, 211/85.2, 85.3, 85.9; 43/4.5, 905, 66.5; D3/203.3, D3/20–29, 203.2, 303, 304, 315, 319, 323, D3/901–905
See application file for complete search history.

(56) References Cited

U.S. PATENT DOCUMENTS 3,911,856 A * 10/1975 Ewing ..... 206/534
5,894,944 A * 4/1999 Swift ..... 211/78
6,938,766 B1 * 9/2005 Lee ..... 206/388

* cited by examiner

*Primary Examiner*—Richard E. Chilcot, Jr.
*Assistant Examiner*—Jared W. Newton

(57) ABSTRACT

A hair accessory organizer device for organizing and holding hair accessories. The hair accessory organizer device includes a bottom tray having bottom and side walls; and also includes pedestal support members including a first pedestal support member being attached upon the bottom tray; and further includes a tubular pedestal being securely and removably attached to the pedestal support members; and also includes a top tray being removably attached upon the tubular pedestal.

4 Claims, 3 Drawing Sheets

HAIR ACCESSORY ORGANIZER DEVICE

BACKGROUND OF THE INVENTION

1. Field of the Invention

The present invention relates to hair accessory organizers and more particularly pertains to a new hair accessory organizer device for organizing and holding hair accessories.

2. Description of the Prior Art

The use of hair accessory organizers is known in the prior art. More specifically, hair accessory organizers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,031,777; U.S. Pat. No. Des. 394,918; U.S. Pat. No. 5,303,855; U.S. Pat. No. Des. 427,378; U.S. Pat. No. 6,076,685; and U.S. Pat. No. 5,626,503.

While these devices fulfill their respective, particular objectives and requirements, the aforementioned patents do not disclose a new hair accessory organizer device. The prior art includes hangers and trays for holding hair accessories.

SUMMARY OF THE INVENTION

The general purpose of the present invention, which will be described subsequently in greater detail, is to provide a new hair accessory organizer device which has many of the advantages of the hair accessory organizers mentioned heretofore and many novel features that result in a new hair accessory organizer device which is not anticipated, rendered obvious, suggested, or even implied by any of the prior art hair accessory organizers, either alone or in any combination thereof. The present invention includes a bottom tray having bottom and side walls; and also includes pedestal support members including a first pedestal support member being attached upon the bottom tray; and further includes a tubular pedestal being securely and removably attached to the pedestal support members; and also includes a top tray being removably attached upon the tubular pedestal. None of the prior art includes the particular structure of the present invention.

There has thus been outlined, rather broadly, the more important features of the hair accessory organizer device in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new hair accessory organizer device which has many of the advantages of the hair accessory organizers mentioned heretofore and many novel features that result in a new hair accessory organizer device which is not anticipated, rendered obvious, suggested, or even implied by any of the prior art hair accessory organizers, either alone or in any combination thereof.

Still another object of the present invention is to provide a new hair accessory organizer device for organizing and holding hair accessories.

Still yet another object of the present invention is to provide a new hair accessory organizer device that is easy and convenient to set up and use.

Even still another object of the present invention is to provide a new hair accessory organizer device that allows the user to keep track of one's hair accessories.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
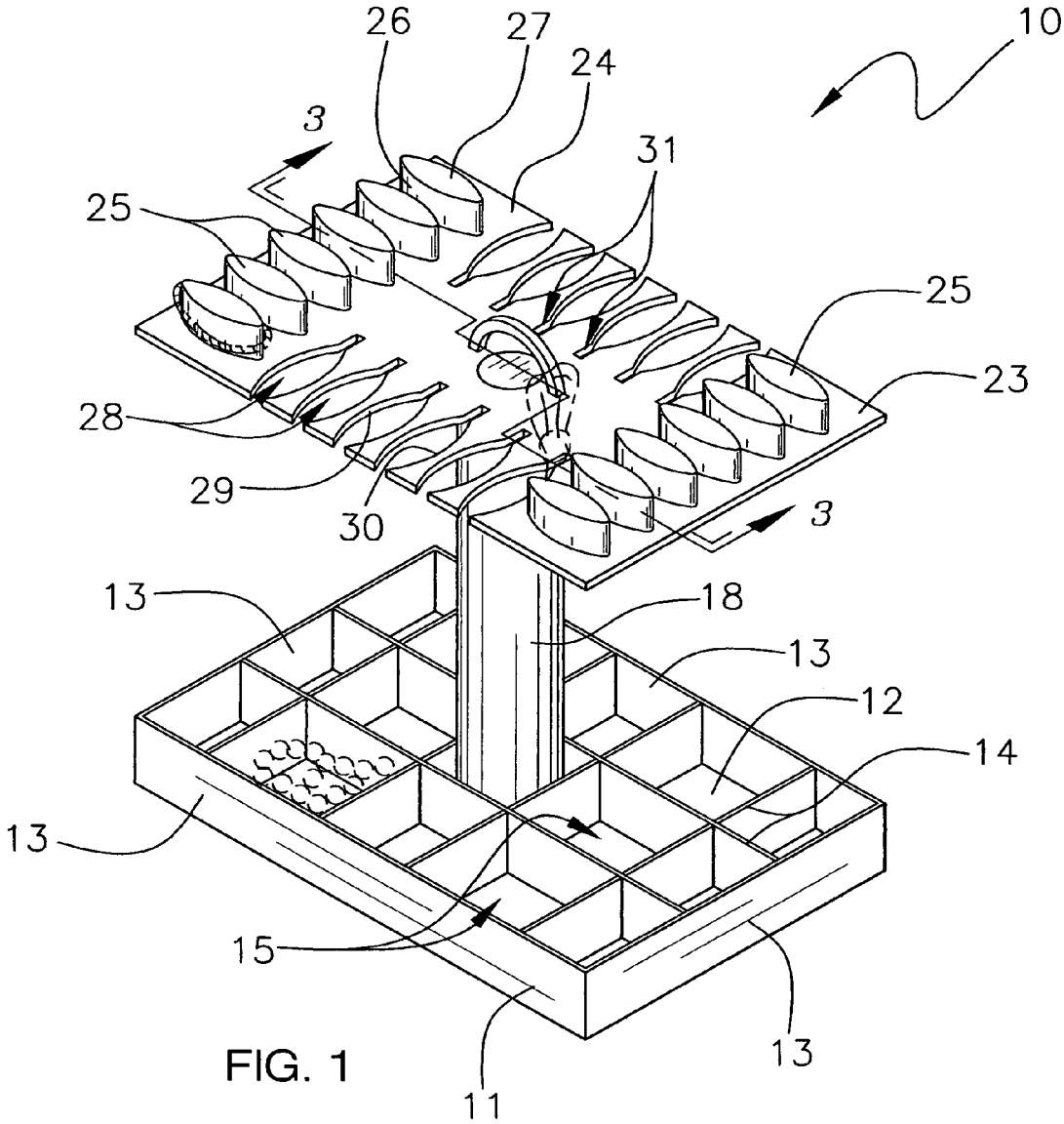
FIG. 1 is a perspective view of a new hair accessory organizer device according to the present invention.
Figure 2:
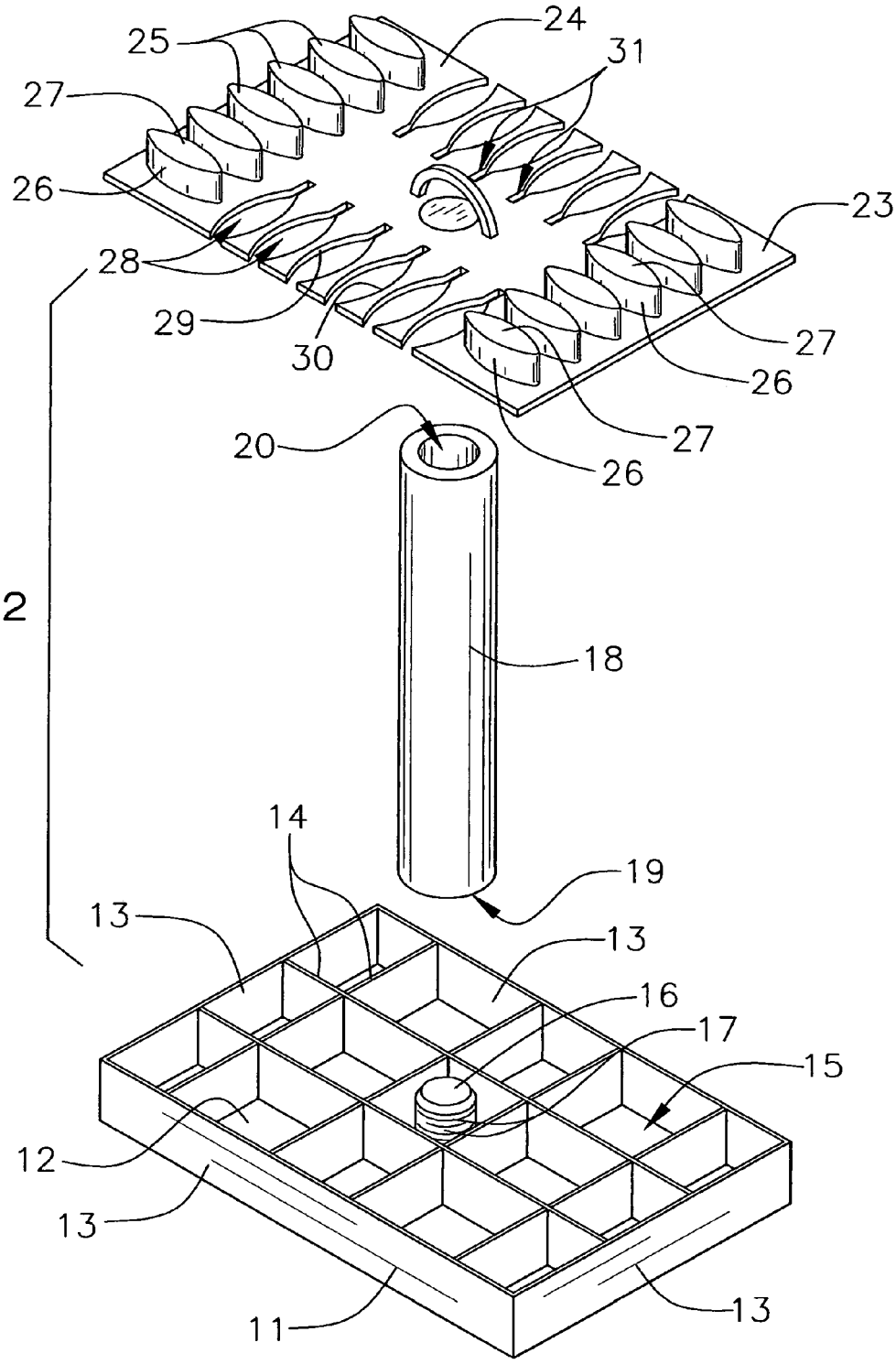
FIG. 2 is an exploded perspective view of the present invention.
Figure 3:
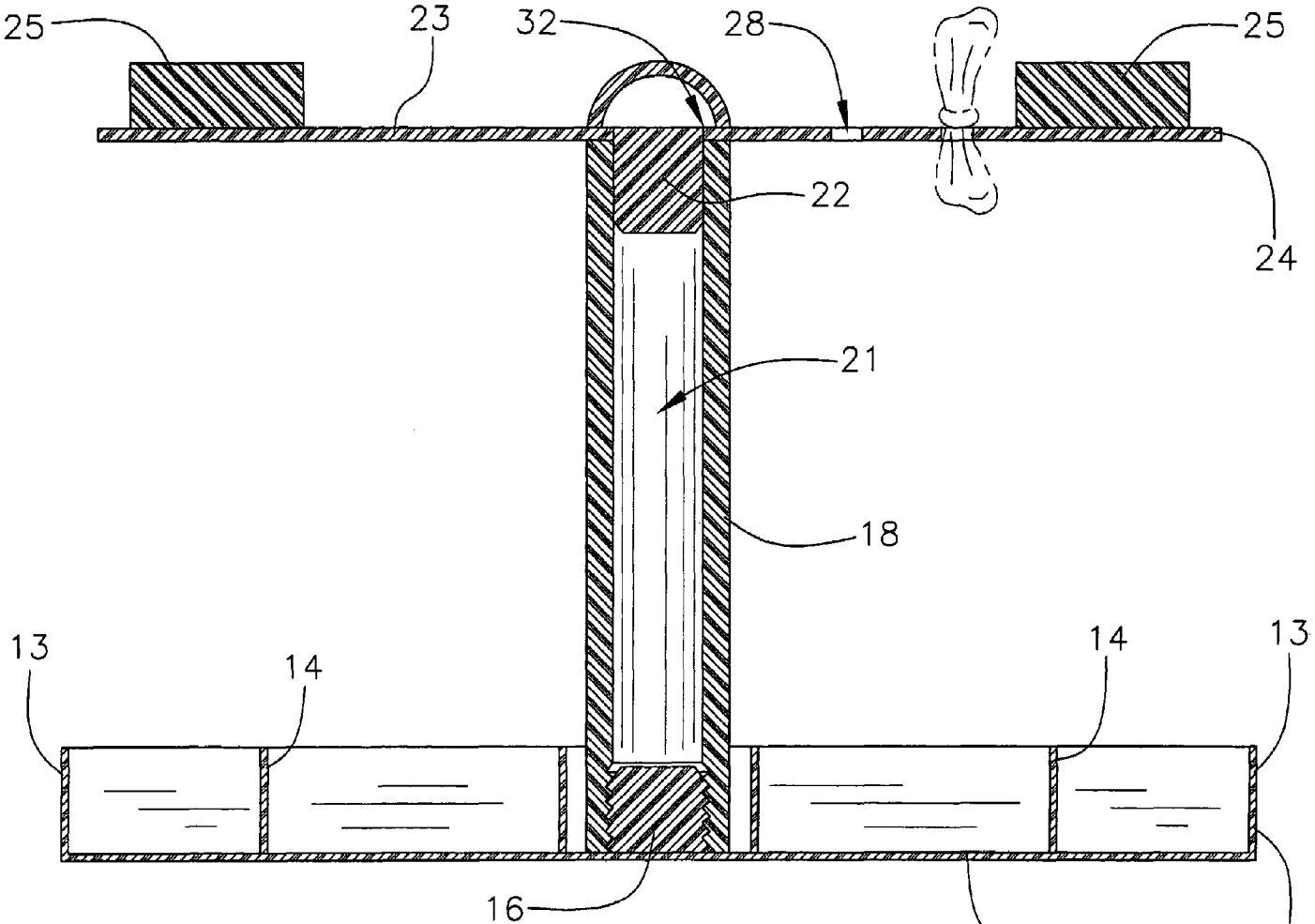
FIG. 3 is a cross-sectional view of the present invention.

With reference now to the drawings, and in particular to FIGS. 1 through 3 thereof, a new hair accessory organizer device embodying the principles and concepts of the present invention and generally designated by the reference numeral 10 will be described.

As best illustrated in FIGS. 1 through 3, the hair accessory organizer device 10 generally comprises a bottom tray 11 having bottom and side walls 12,13. The bottom tray 11 also includes a plurality of partitions 14 being conventionally disposed upon the bottom wall 12 of the bottom tray 11 and being arranged to form a plurality of storage compartments 15.

Pedestal support members 16,22 include a first pedestal support member 16 being conventionally attached upon the bottom tray 11. The pedestal support members 16,22 are generally boss members. The first pedestal support member 16 is centrally disposed upon the bottom wall 12 in one of the storage compartments 15 of the bottom tray 11 and has external threads 17 being conventionally disposed about a side wall thereof.

A tubular pedestal 18 is securely and removably attached to the pedestal support members 16,22. The tubular pedestal 18 has open top and bottom ends 19,20 and a bore 21 extending therethrough with the first pedestal support member 16 being threadingly received in the bore 21 through the open bottom end 19 of the tubular pedestal 18.

A top tray 23 is removably attached upon the tubular pedestal 18. The pedestal support members 16,22 also include a second pedestal support member 22 which is centrally-attached to and disposed in a hole 32 in a bottom side of a wall 24 of the top tray 23 and is engageably and removably received in the bore 21 through the open top end 19 of the tubular pedestal member 18. The top tray 23 also includes a plurality of members 25 for holding bands being spacedly and conventionally disposed upon a top side of the wall 24 thereof, and further includes a plurality of slots 28 for receiving ribbons being spacedly and conventionally disposed along and in edges of the wall 24 thereof. Each of the members 25 for holding bands is generally a block having opposed longitudinal sides 26,27 which are joined at ends thereof and which have central portions which are bowed outwardly for holding and supporting ponytail bands, in particular. The members 25 for holding bands include first and second sets of the members 25 for holding bands which are opposedly disposed along edges of the wall 24 of the top tray 23. The members 25 for holding bands of each of the first and second sets of the members 25 for holding bands are spacedly aligned side-by-side. Each of the slots 28 for receiving ribbons is defined by side edges 29,30 which have central portions which are bowed away from one another, and which also have end portions which are closely spaced from one another thus generally forming a narrow slot portion 31 for engaging a ribbon therein. The slots 28 for receiving ribbons include first and second sets of the slots for receiving ribbons which are opposedly disposed along the edges of the wall 24 of the top tray 23 with the slots 28 for receiving ribbons being spacedly disposed side-by-side.

In use, the user places hair pins, and clips as such in the storage compartments 15 on the bottom tray 11, and places the ponytail bands about the members 25 for holding bands on the top tray 23, and also inserts the ribbons in the narrow slot portions 31 of the slots 28 for receiving ribbons. When the hair accessories are needed, the user simply removes them from the hair accessory organizer device 10, and when they are not needed, the user simply returns them to the hair accessory organizer device 10.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the hair accessory organizer device. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A hair accessory organizer device comprising:

a bottom tray having bottom and side walls, said bottom tray also including a plurality of partitions being disposed upon said bottom wall of said bottom tray and being arranged to form a plurality of storage compartments;

pedestal support members including a first pedestal support member being attached upon said bottom tray, said pedestal support members being boss members, said first pedestal support member being centrally-disposed upon said bottom wall in one of said storage compartments of said bottom tray and has external threads being disposed about a side wall thereof;

a tubular pedestal being securely and removably attached to said pedestal support members, said tubular pedestal having open top and bottom ends and a bore extending therethrough, said first pedestal support member being threadingly received in said bore through said open bottom end of said tubular pedestal, said pedestal support members also including a second pedestal support member which is centrally-attached and engages in a hole in a bottom side of a wall of said top tray and is engageably and removably received in said bore through said open top end of said tubular pedestal; and a top tray being removably attached upon said tubular pedestal, said top tray also including a plurality of members for holding bands being spacedly disposed upon a top side of said wall thereof, and further including a plurality of slots for receiving ribbons being spacedly disposed along and in edges of said wall thereof, each of said members for holding bands is generally a block having opposed longitudinal sides which are joined at ends thereof and which have central portions which are bowed outwardly for holding and supporting ponytail bands, in particular.

2. A hair accessory organizer device as described in claim 1, wherein said members for holding bands include first and second sets of said members for holding bands which are opposedly disposed along edges of said wall of said top tray.

3. A hair accessory organizer device as described in claim 2, wherein said members for holding bands of each of said first and second sets of said members for holding bands are spacedly aligned side-by-side.

4. A hair accessory organizer device comprising:

a bottom tray having bottom and side walls, said bottom tray also including a plurality of partitions being disposed upon said bottom wall of said bottom tray and being arranged to form a plurality of storage compartments;

pedestal support members including a first pedestal support member being attached upon said bottom tray, said pedestal support members being boss members, said first pedestal support member being centrally-disposed upon said bottom wall in one of said storage compartments of said bottom tray and has external threads being disposed about a side wall thereof;

a tubular pedestal being securely and removably attached to said pedestal support members, aid tubular pedestal having open top and bottom ends and a bore extending therethrough, said first pedestal support member being threadingly received in said bore through said open bottom end of said tubular pedestal, said pedestal support members also including a second pedestal support member which is centrally-attached and engages in a hole in a bottom side of a wall of said top tray and is engageably and removably received in said bore through said open top end of said tubular pedestal, and a top tray being removably attached upon said tubular pedestal, said top tray also including a plurality of members for holding bands being spacedly disposed upon a top side of said wall thereof, and further including a plurality of slots for receiving ribbons being spacedly disposed along and in edges of said wall thereof, each of said slots for receiving ribbons being defined by side edges which have central portions which are bowed away from one another and which also have end portions which are closely spaced from one another thus generally forming a narrow slot portion for engaging a ribbon therein, said slots for receiving ribbons including first and second sets of said slots for receiving ribbons which are opposedly disposed along said edges of said wall of said top tray with said slots for receiving ribbons being spacedly disposed side-by-side.

* * * * *